US011132884B2

(12) United States Patent
Castillo-Garza

(10) Patent No.: US 11,132,884 B2
(45) Date of Patent: Sep. 28, 2021

(54) SMOKE AND STEAM DETECTOR

(71) Applicant: Carrier Corporation, Palm Beach Gardens, FL (US)

(72) Inventor: Jose-Rodrigo Castillo-Garza, West Hartford, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 17/254,204

(22) PCT Filed: May 20, 2020

(86) PCT No.: PCT/US2020/033715
§ 371 (c)(1),
(2) Date: Dec. 18, 2020

(87) PCT Pub. No.: WO2020/251733
PCT Pub. Date: Dec. 17, 2020

(65) Prior Publication Data

US 2021/0264758 A1 Aug. 26, 2021

Related U.S. Application Data

(60) Provisional application No. 62/861,652, filed on Jun. 14, 2019.

(51) Int. Cl.
*G08B 17/107* (2006.01)
*G08B 17/113* (2006.01)
(Continued)

(52) U.S. Cl.
CPC ..... *G08B 17/107* (2013.01); *G08B 7/06* (2013.01); *G08B 17/113* (2013.01); *G08B 25/10* (2013.01); *G08B 29/04* (2013.01)

(58) Field of Classification Search
CPC .... G08B 17/107; G08B 17/113; G08B 29/04; G08B 7/06; G08B 25/10
(Continued)

(56) References Cited

U.S. PATENT DOCUMENTS 3,728,703 A * 4/1973 Burnett ..... G08B 17/11 340/629
5,260,687 A * 11/1993 Yamauchi ..... G08B 17/00 340/511
(Continued)

FOREIGN PATENT DOCUMENTS

| | | |
|---|---|---|
| EP | 0940789 | 9/1999 |
| EP | 2320399 | 5/2011 |
| WO | 2018050461 | 3/2018 |

OTHER PUBLICATIONS

International Search Report and Written Opinion for International Application No. PCT/US2020/033715 dated Sep. 7, 2020.

*Primary Examiner* — John A Tweel, Jr.
(74) *Attorney, Agent, or Firm* — Carlson, Gaskey & Olds, P.C.

(57) ABSTRACT

A device for detecting a hazardous condition in an area includes a housing defining a chamber. There is at least one smoke sensing device for detecting the presence of smoke in the chamber. An extremely-high frequency detector includes at least one extremely-high frequency transmitter positioned relative to at least one extremely-high frequency receiver.

19 Claims, 4 Drawing Sheets

(51) Int. Cl.
*G08B 29/04* (2006.01)
*G08B 7/06* (2006.01)
*G08B 25/10* (2006.01)

(58) Field of Classification Search
USPC ..... 340/630
See application file for complete search history.

(56) References Cited

U.S. PATENT DOCUMENTS

| | | | | |
|---|---|---|---|---|
| 9,098,988 | B2 * | 8/2015 | Ju | G01N 21/53 |
| 9,390,605 | B2 | 7/2016 | Schmid | |
| 9,552,711 | B2 * | 1/2017 | Peterson | G08B 29/188 |
| 10,163,333 | B2 * | 12/2018 | Bruck | G06K 9/00744 |
| 2014/0197957 | A1 * | 7/2014 | Fischer | G08B 17/107 340/630 |

* cited by examiner

SMOKE AND STEAM DETECTOR

CROSS-REFERENCE TO RELATED APPLICATIONS

This application claims priority to U.S. Provisional Application No. 62/861,652, which was filed on Jun. 14, 2019 and is incorporated herein by reference.

BACKGROUND

The subject matter disclosed herein relates to detection systems, and more specifically, to a system and method for evaluating a condition of a detection device.

Life safety devices, such as commercial and/or industrial smoke detectors, often located inside of a housing or enclosure, use light scattering to detect the presence of a hazardous condition in the area being monitored. However, most conventional life safety devices are not capable of distinguishing between hazardous conditions and other nuisance conditions that typically occur, such as the presence of dust or steam adjacent the detector. False alarms are more likely to occur as a result of these other particles.

SUMMARY

In one exemplary embodiment, a device for detecting a hazardous condition in an area includes a housing defining a chamber. There is at least one smoke sensing device for detecting the presence of smoke in the chamber. An extremely-high frequency detector includes at least one extremely-high frequency transmitter positioned relative to at least one extremely-high frequency receiver.

In a further embodiment of any of the above, the at least one extremely-high frequency transmitter is configured to generate a frequency of approximately 183 GHz.

In a further embodiment of any of the above, the at least one extremely-high frequency transmitter is configured to generate a frequency between 180 GHz and 190 GHz.

In a further embodiment of any of the above, the at least one extremely-high frequency transmitter and the at least one extremely-high frequency receiver are located within the chamber.

In a further embodiment of any of the above, the at least one extremely-high frequency transmitter is located directly across the chamber from the at least one extremely-high frequency receiver.

In a further embodiment of any of the above, the at least one extremely-high frequency transmitter and the at least one extremely-high frequency receiver are located on an exterior of the housing.

In a further embodiment of any of the above, the at least one extremely-high frequency transmitter includes a plurality of extremely-high frequency transmitters. The at least one extremely-high frequency receiver includes a plurality of extremely-high frequency receivers.

In a further embodiment of any of the above, the plurality of extremely-high frequency transmitters are positioned in a non-line of sight configuration with the plurality of extremely-high frequency receivers.

In a further embodiment of any of the above, a portion of the housing includes a plurality of openings in fluid communication with the chamber and an exterior of the housing.

In a further embodiment of any of the above, the at least one smoke sensing device includes a photoelectric detector having a light source and a photoelectric sensor.

In a further embodiment of any of the above, the at least one smoke sensing device includes an ionization detector including an ionization source, a positive plate electrode, and a negative plate electrode.

In a further embodiment of any of the above, the at least one smoke sensing device includes a photoelectric detector and an ionization detector.

In a further embodiment of any of the above, the at least one extremely-high frequency transmitter includes a high frequency generator in communication with a transmitting antenna. The at least one extremely-high frequency receiver includes an antenna in electrical communication with a receiver with a lens for focusing EHF waves.

In another exemplary embodiment, a method of operating a device for detecting a hazardous condition in an area includes the step of determining with at least one smoke sensing detector if smoke is present in the air adjacent the device. An extremely-high frequency detector is used to determine if water is present in air adjacent the device. The method includes the step of determining if an alarm should be triggered to indicate a hazardous condition based on the extremely-high frequency detector and the at least one smoke sensing detector.

In a further embodiment of any of the above, the extremely-high frequency detector includes at least one extremely-high frequency transmitter and at least one extremely-high frequency receiver. The at least one extremely-high frequency transmitter generates a frequency between 180 GHz and 190 GHz to determine the presence of the water in the air.

In a further embodiment of any of the above, the method includes determining the presence of water in the air by measuring a distortion of the signal generated by the at least one extremely-high frequency transmitter with the at least one extremely-high frequency receiver.

In a further embodiment of any of the above, the at least one smoke sensing detector includes at least one of a photoelectric detector or an ionization detector.

In a further embodiment of any of the above, the extremely-high frequency detector and the at least one smoke sensing detector are located within a chamber at least partially defined by a housing of the device.

In a further embodiment of any of the above, the device provides an alarm if the extremely-high frequency detector does not detect water in the air and if the at least one smoke sensing detector is triggered.

In a further embodiment of any of the above, the device does not provide an alarm if the extremely-high frequency detector detects water in the air and if the at least one smoke sensing device is triggered.

DETAILED DESCRIPTION

Figure 1:
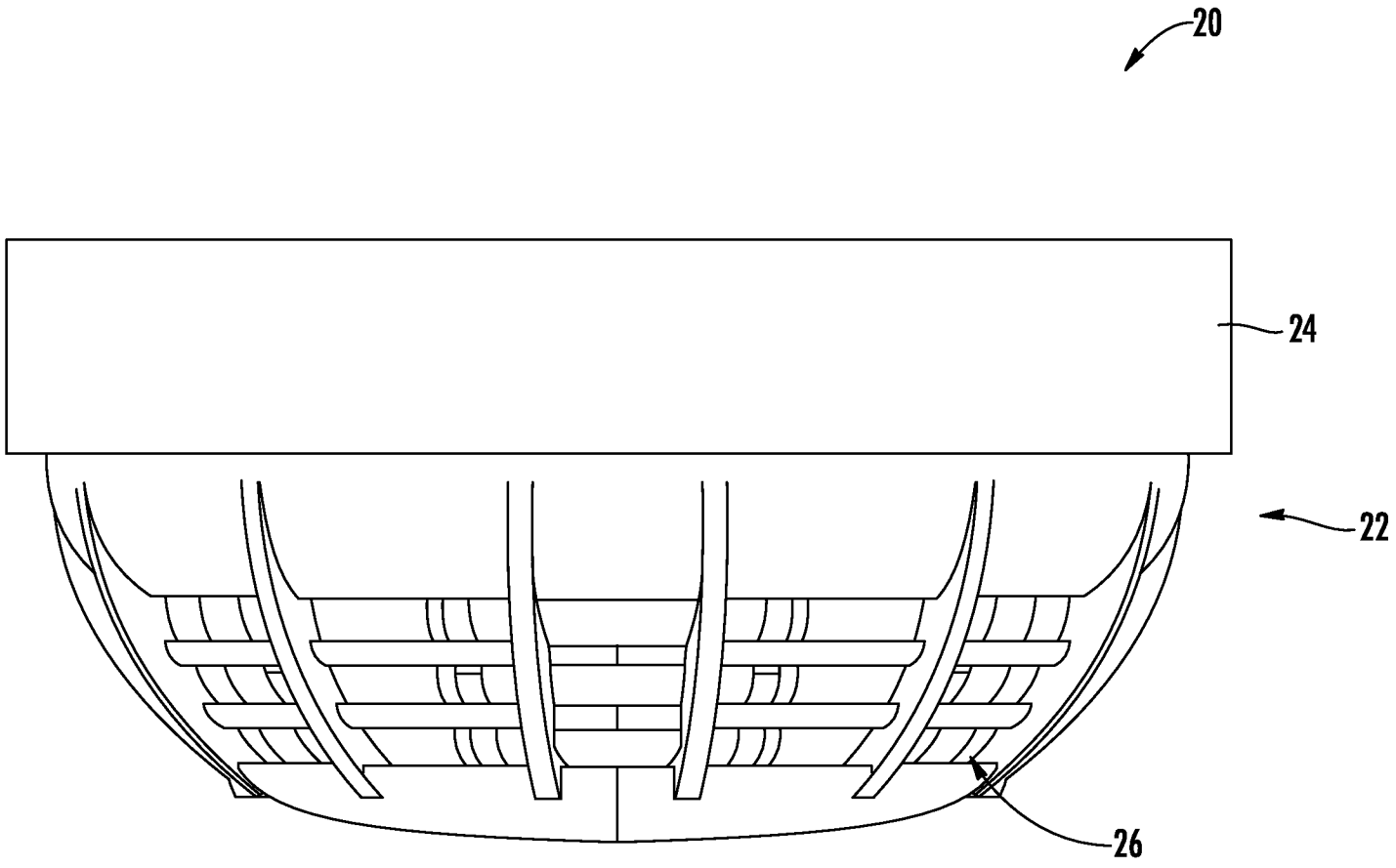
FIG. 1 illustrates an example detection device.

FIG. 1 illustrates an example detection device 20. One feature of the detection device 20 is to reduce or eliminate false or nuisance alarms resulting from high number of water particles in the vicinity of the detection device as will be described in more detail below. The detection device 20 includes a housing 22 enclosing the internal electronics of the detection device 20 and a base 24 for attaching the detection device 20 to another structure such as a wall. The housing 22 also includes a plurality of inlets 26 located in a domed portion of the housing 22. The inlets 26 provide fluid communication between an exterior of the housing 22 and an interior chamber 28 (FIGS. 2-3) that allows particles or smoke in the surrounding air to enter the detection device 20.

Figure 2:
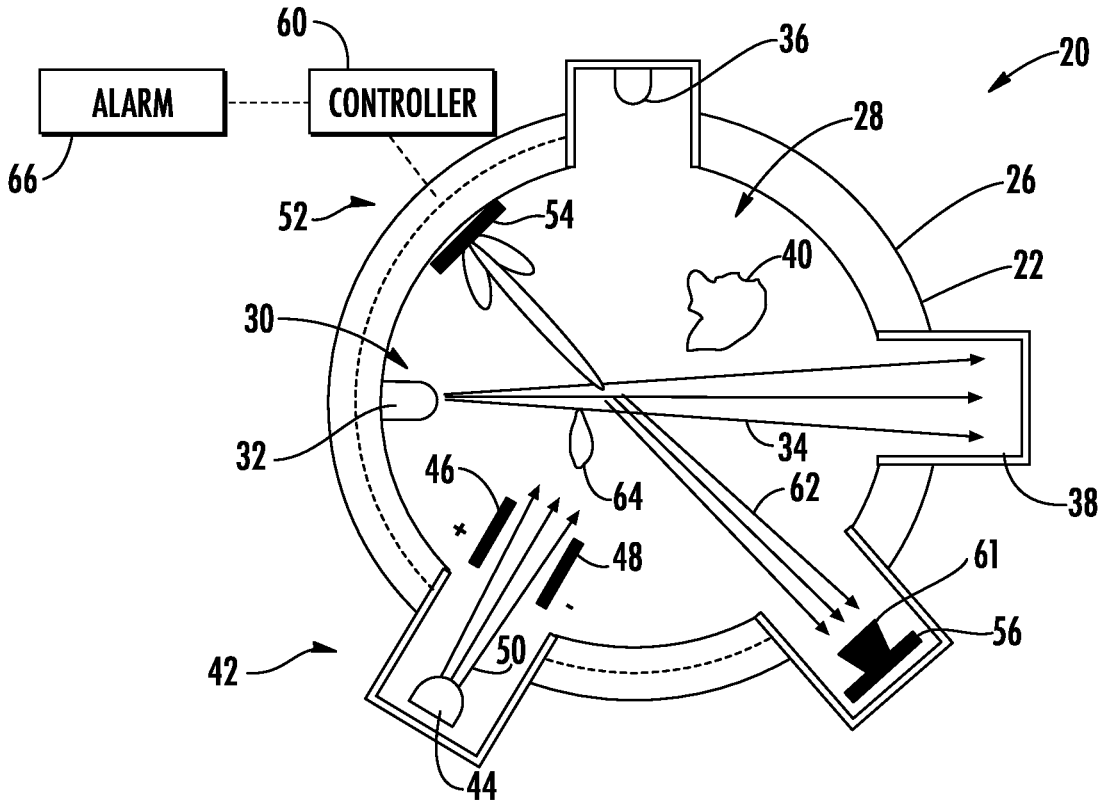
FIG. 2 illustrates a schematic view of an example interior of the detection device of FIG. 1.

FIG. 2 schematically illustrates an example of the various components (not shown to scale) within the detection device 20 used for detecting smoke 40 and other particles in the air, such as water particles 64. In the illustrated example, the various components in the detection device 20 include a photoelectric detector 30, an ionization detector 42, and an extremely high-frequency ("EHF") detector 52 located within or adjacent the detection device 20. Although the illustrated example depicts both the photoelectric detector 30 and the ionization detector 42, an alternative detector may use only one of these two components in connection with the EHF detector 52 in the detection device 20.

In the illustrated example, the photoelectric detector 30 includes a photoelectric transmitter 32, such as a light source, located opposite a light catcher 38. The light catcher 38 prevents or reduces light from originating from the photoelectric transmitter 32 to scatter within the housing 22, rather light will scatter primarily from smoke 40 and water 64. The photoelectric detector 30 also includes a photoelectric sensor 36 located outside of the normal path for light rays 34 emitted from the photoelectric transmitter 32 towards the light catcher 38. A controller 60 is in electrical communication with the photoelectric transmitter 32 and programmed to trigger the generation of the light rays 34 and determine or measure the reception of the light rays 34 with the photoelectric sensor 36. The controller 60 includes memory and a microprocessor to perform the programmed tasks described herein.

The photoelectric sensor 36 receives the light rays 34 transmitted from the photoelectric transmitter 32 that may be scattered by smoke 40 located within the chamber 28. Although the photoelectric detector 30 is intended to identify smoke 40 within the chamber 28, the presence of water particles 64 within the chamber 28 can also cause the light rays 34 to scatter and be received by the photoelectric sensor 36. When the water particles 64 cause the light rays 34 to scatter, this could cause the controller 60 to trigger an alarm 66 in a traditional detection device. One feature of the present invention is to allow the device 20 to distinguish water 64 from smoke 40 and avoid the alarm 66 being triggered without the presence of smoke 40.

The ionization detector 42 includes an ionization source 44, a positive plate electrode 46, and a negative plate electrode 48. The ionization source 44 converts air molecules into positively and negatively charged ions and because opposite charges attract, the negatively charged ions move towards the positive plate electrode 46 and the positively charged ions move towards the negative plate electrode 48. The movement of positively and negatively charged ions completes a circuit in the ionization detector 42 by allowing electricity to flow between the positive plate electrode 46 and the negative plate electrode 48. The controller 60 is in electrical communication with the positive plate electrode 46 and the negative plate electrode 48 and can measure changes in electrical flow between the positive and negative plate electrodes 46, 48 resulting from changes in an ion flow 50.

When smoke 40 or water particles 64 enter the chamber 28, the ions from the ionization source 44 bond with the smoke 40 or the water particles 64. When the ions bond with the smoke 40 or the water particles 64 instead of the positive and negative plate electrodes 46, 48, there is a reduction of electrical flow in the circuit of the ionization detector 42 that is measurable by the controller 60. Because both the smoke 40 and the water particles 64 can bond with the ions, in a traditional detection device the controller 60 could trigger the alarm 66 based on the presence of water particles 64 located in the chamber 28 and not smoke 40. In the absence of smoke particles 40 it is desirable to avoid the alarm 66 being triggered in the presence of the water particles 64, which is accomplished with the method further explained below.

Although the photoelectric detector 30 and the ionization detector 42 are each capable of identifying the presence of smoke 40 within the chamber 28, other substances that may enter the chamber 28 can cause the photoelectric detector 30 and/or the ionization detector 42 to indicate the presence of smoke 40 within the chamber 28 as described above. When the photoelectric detector 30 and the ionization detector 42 incorrectly identify the presence of smoke 40 within the chamber 28, this creates a situation referred to as a "nuisance alarm." The nuisance alarm is a situation where the detection device 20 may sound the alarm 66 without the presence of smoke 40. As discussed above, water particles 64 in the chamber 28 can lead the controller 60 to believe that there is smoke 40 within detection device 20 when using either the photoelectric detector 30, the ionization detector 42, or both.

In order to reduce the possibility of false or nuisance alarms, the detection device 20 includes the EHF detector 52 in communication with the controller 60 to validate the determination by either the photoelectric detector 30 or the ionization detector 42 of the presence of the smoke 40. The EHF detector 52 provides validation by identifying the presence of the water particles 64 in the vicinity of the detection device 20. The EHF detector 52 includes an EHF transmitter 54 having an EHF generator capable of generating an EHF wave 62 and transmitting the EHF wave with an antenna. In one example, the extremely high frequency generated by the EHF transmitter is between 180 GHz and 190 GHz and in another example, the extremely high frequency is approximately 183 GHz. The EHF waves 62 might be transmitted through pulses or by a constant stream of waves. In the illustrated example, the EHF detector 52 also includes an EHF receiver 56 located directly across from the EHF transmitter 54 having a lens 61 and an antenna for receiving the EHF waves 62 with a receiver.

The EHF detector 52 detects water particles 64 without receiving interference from the smoke 40 by generating the EHF waves 62 with the EHF transmitter 54. Because the frequency generated by the EHF transmitter 54 is so high, the EHF waves 62 encounter little or no interference from the smoke particles 40 within the chamber 28. Therefore, when smoke 40 is present inside the chamber 28, the EHF receiver 56 measures little or no reduction in signal of the EHF waves 62 generated by the EHF transmitter 54. As shown in FIG. 2, the EHF receiver 56 may include a lens 61 for focusing the EHF waves 62. However, the water particles 64 are able to absorb or reflect the EHF waves 62 to a greater degree than the smoke 40. To determine the presence of the water particles 64 the controller 60 identifies the variation in the EHF waves 62 from an expected value compared to a measured value of sensors 36 and/or 46, 48.

The controller 60 utilizes the information gathered by the photoelectric detector 30, the ionization detector 42, and the EHF detector 52 to determine whether or not the alarm 66 should be provided and eliminates or greatly reduces the number of nuisance alarms provided by the detection device 20. The alarm 66 can include at least one of an audio or visual indicator or the alarm 66 can communicate with a remote location to indicate the presence of the smoke 40 in the vicinity of the detection device 20.

Figure 3:
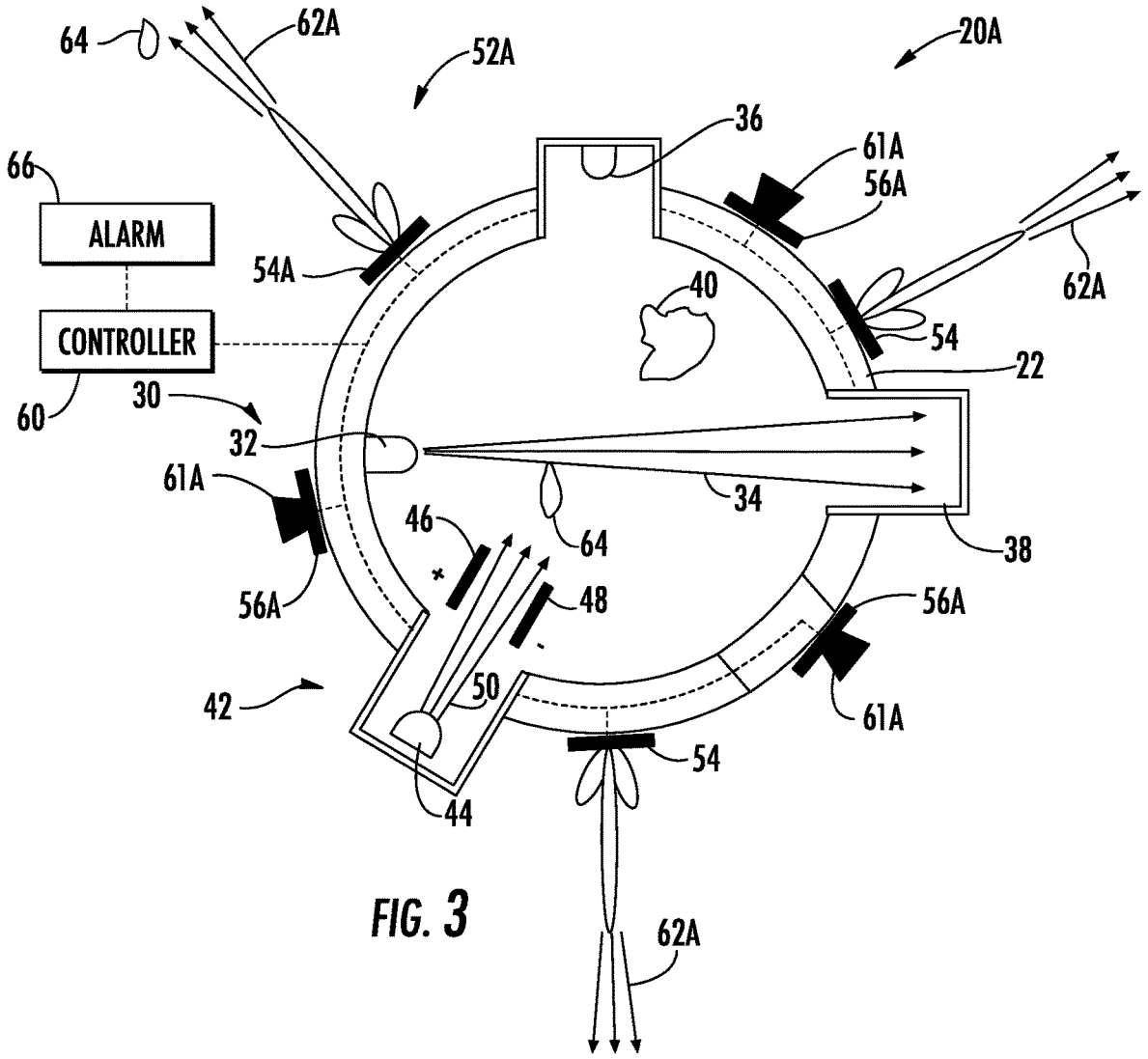
FIG. 3 illustrates a schematic view of another example interior of the detection device of FIG. 1.

FIG. 3 illustrates a schematic view of another example detection device 20A. The detection device 20A is similar to the detection device 20 except where described below or shown in the Figures. In particular the detection device 20A includes the photoelectric detector 30 having the photoelectric transmitter 32 opposite the light catcher 38 with the photoelectric sensor 36 for measuring distortions of the light rays 34 as described above. Additionally, the detection device 20A includes the ionization detector 42 having the ionization source 44 with the positive and negative plate electrodes 46, 48 that measure variations in the ion flow 50 resulting from the smoke 40 or water particles 64 as described above.

However, the detection device 20A includes an EHF detector 52A located on an exterior of the housing 22. The EHF detector 52A includes multiple EHF transmitters 54A and multiple EHF receivers 56A with a lens 61A for directing EHF waves 62A into the EHF receiver 56A. However, the multiple EHF transmitters 54A and the multiple EHF receives 56A are oriented in a non-line of sight configuration on the exterior of the housing 22, such that the none of the multiple EHF transmitters 54A are pointed directly at any of the multiple EHF receivers 56A. Similar to the EHF detector 52 described above, the EHF receivers 56A measure a reduction in the EHF waves 62A that are absorbed or distorted by the water particles 64. The controller 60 is programmed to determine when the EHF waves 62A received by the EHF receivers 56A correspond to a reduction in the signal of the EHF waves 62A resulting from the water particles 64 in the vicinity of the detection device 20A as opposed to the EHF waves 62A reflecting off of adjacent structures such as walls.

Figure 4:
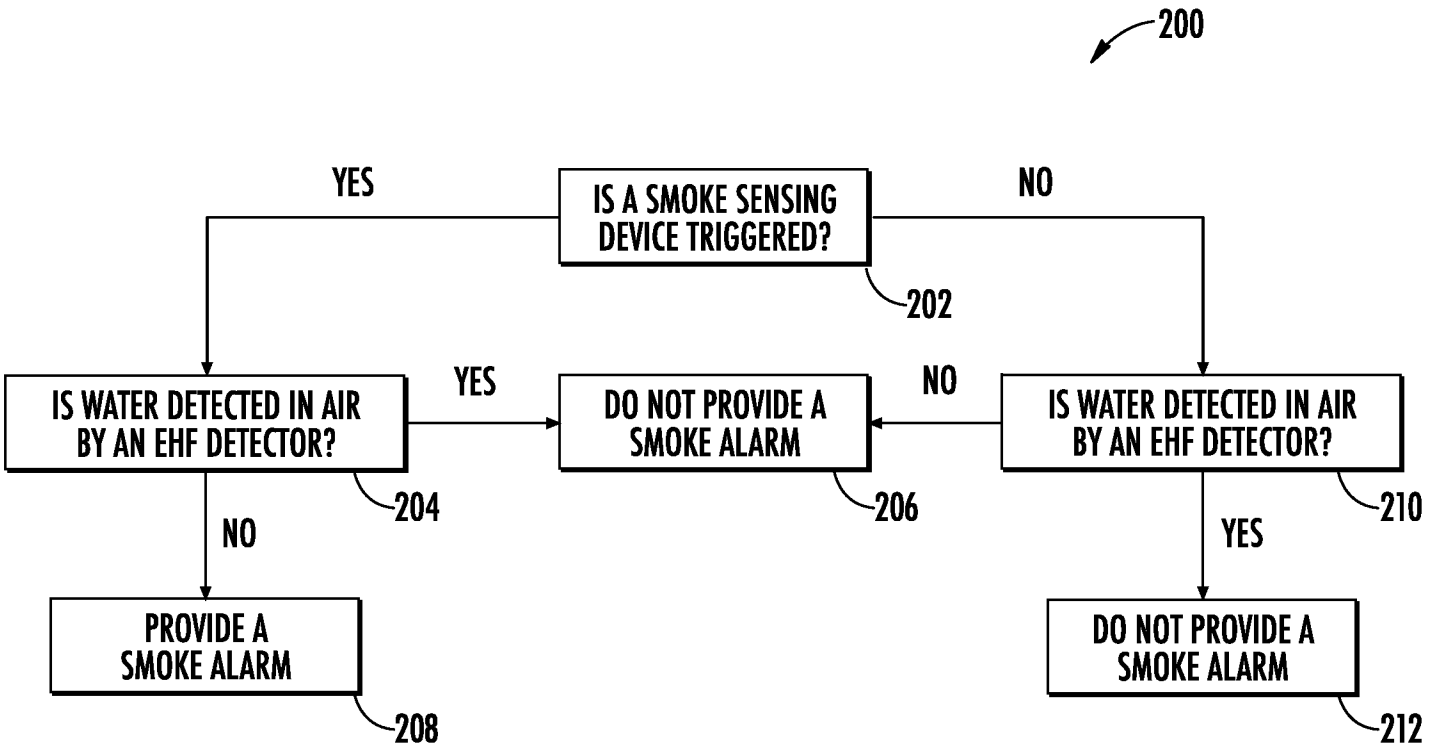
FIG. 4 illustrates an example method for operating the detection device of FIG. 1.

FIG. 4 illustrates an example method 200 for operating either of the detection devices 20, 20A described above. The method 200 includes determining if smoke 40 is detected in the chamber 28. (Step 202). The determination of the presence of smoke 40 within the chamber 28 is made with the controller 60 monitoring at least one of the photoelectric detector 30 or the ionization detector 42 as described above. If the photoelectric detector 30 or the ionization detector 42 detects the presence of smoke 40 as determined by the controller 60, then the detection devices 20, 20A will determine if water particles 64 are detected in the air surrounding the detection device 20, 20A. (Step 204).

The controller 60 in the detection devices 20, 20A determines if water particles 64 are in the air through monitoring a respective one of the EHF detectors 52, 52A, as described in more detail above. If it is determined by the controller 60 in communication with one of the EHF detectors 52, 52A that water particles 64 are present in the air, then the detection devices 20, 20A will not provide an alarm. (Step 206). If it is determined by the controller 60 in communication with one of the EHF detectors 52, 52A that water particles 64 are not present in the air, then the detection devices 20, 20A will provide the alarm 66. (Step 208).

If smoke 40 is not detected in the chamber 28 by at least one of the photoelectric detector 30 or the ionization detector 42, the controller 60 in the detections devices 20, 20A will determine if water particles 64 are present in the air through monitoring a respective one of the EHF detectors 52, 52A. (Step 210). If water particles 64 are in the air, the detection devices 20, 20A will not provide an alarm. (Step 212). Furthermore, if water particles 64 are not in the air, the detection devices 20, 20A will not provide an alarm. (Step 206).

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A device for detecting a hazardous condition in an area, comprising:

a housing defining a chamber;

at least one smoke sensing device for detecting the presence of smoke in the chamber; and an extremely-high frequency detector including at least one extremely-high frequency transmitter positioned relative to at least one extremely-high frequency receiver, wherein the at least one extremely-high frequency transmitter includes a high frequency generator in communication with a transmitting antenna and the at least one extremely-high frequency receiver includes an antenna in electrical communication with a receiver and a lens for focusing EHF waves.

2. The device of claim 1, wherein the at least one extremely-high frequency transmitter is configured to generate a frequency of approximately 183 GHz.

3. The device of claim 1, wherein the at least one extremely-high frequency transmitter is configured to generate a frequency between 180 GHz and 190 GHz.

4. The device of claim 3, wherein the at least one extremely-high frequency transmitter and the at least one extremely-high frequency receiver are located within the chamber.

5. The device of claim 4, wherein the at least one extremely-high frequency transmitter is located directly across the chamber from the at least one extremely-high frequency receiver.

6. The device of claim 1, wherein the at least one extremely-high frequency transmitter and the at least one extremely-high frequency receiver are located on an exterior of the housing.

7. The device of claim 6, wherein the at least one extremely-high frequency transmitter includes a plurality of extremely-high frequency transmitters and the at least one extremely-high frequency receiver includes a plurality of extremely-high frequency receivers.

8. The device of claim 7, wherein the plurality of extremely-high frequency transmitters are positioned in a non-line of sight configuration with the plurality of extremely-high frequency receivers.

9. The device of claim 1, wherein a portion of the housing includes a plurality of openings in fluid communication with the chamber and an exterior of the housing.

10. The device of claim 1, wherein the at least one smoke sensing device includes a photoelectric detector having a light source and a photoelectric sensor.

11. The device of claim 1, wherein the at least one smoke sensing device includes an ionization detector including a ionization source, a positive plate electrode, and a negative plate electrode.

12. The device of claim 1, wherein the at least one smoke sensing device includes a photoelectric detector and an ionization detector.

13. A method of operating a device for detecting a hazardous condition in an area, comprising the steps of:

determining with at least one smoke sensing detector if smoke is present in the air adjacent the device;

determining with an extremely-high frequency detector if water is present in air adjacent the device; and determining if an alarm should be triggered to indicate a hazardous condition based on the extremely-high frequency detector and the at least one smoke sensing detector;

wherein the device does not provide an alarm if the extremely-high frequency detector detects water in the air and if the at least one smoke sensing device is triggered.

14. The method of claim 13, wherein the extremely-high frequency detector includes at least one extremely-high frequency transmitter and at least one extremely-high frequency receiver and the at least one extremely-high frequency transmitter generates a frequency between 180 GHz and 190 GHz to determine the presence of the water in the air.

15. The method of claim 13, wherein the at least one smoke sensing detector includes at least one of a photoelectric detector or an ionization detector.

16. The method of claim 13, wherein the extremely-high frequency detector and the at least one smoke sensing detector are located within a chamber at least partially defined by a housing of the device.

17. The method of claim 13, wherein the device provides an alarm if the extremely-high frequency detector does not detect water in the air and if the at least one smoke sensing detector is triggered.

18. The method of claim 14, including determining the presence of water in the air by measuring a distortion of the signal generated by the at least one extremely-high frequency transmitter with the at least one extremely-high frequency receiver.

19. A method of operating a device for detecting a hazardous condition in an area, comprising the steps of:

determining with at least one smoke sensing detector if smoke is present in the air adjacent the device;

determining with an extremely-high frequency detector if water is present in air adjacent the device, wherein the extremely-high frequency detector includes at least one extremely-high frequency transmitter and at least one extremely-high frequency receiver and at least one extremely-high frequency transmitter generates a frequency between 180 GHz and 190 GHz to determine the presence of the water in the air;

determining if an alarm should be triggered to indicate a hazardous condition based on the extremely-high frequency detector and the at least one smoke sensing detector; and determining the presence of water in the air by measuring a distortion of the signal generated by the at least one extremely-high frequency with the at least on extremely-high frequency receiver.

* * * * *